US006386191B1

(12) United States Patent
Yoshimura et al.

(10) Patent No.: US 6,386,191 B1
(45) Date of Patent: May 14, 2002

(54) CSP PLATE HOLDER

(75) Inventors: Eiichi Yoshimura; Shinichi Namioka, both of Tokyo (JP)

(73) Assignee: Disco Corporation, Tokyo (JP)

( * ) Notice: Subject to any disclaimer, the term of this patent is extended or adjusted under 35 U.S.C. 154(b) by 0 days.

(21) Appl. No.: 09/652,021

(22) Filed: Aug. 31, 2000

(30) Foreign Application Priority Data

Sep. 10, 1999 (JP) ..... 11-257256

(51) Int. Cl.[7] ..... B28D 7/04
(52) U.S. Cl. ..... 125/35; 451/388; 269/21
(58) Field of Search ..... 451/388; 125/35, 125/13.01; 269/21

(56) References Cited

U.S. PATENT DOCUMENTS 3,809,050 A * 5/1974 Chough et al. ..... 125/35
3,811,182 A * 5/1974 Ryan, Sr. et al. ..... 29/574
3,976,288 A * 8/1976 Cuomo, Jr. ..... 269/21
4,600,936 A * 7/1986 Khoury et al. ..... 357/79
5,605,489 A * 2/1997 Gale et al. ..... 451/388
5,618,759 A * 4/1997 Boysel ..... 438/464
5,641,714 A * 6/1997 Yamanaka ..... 438/14
5,964,646 A * 10/1999 Kassir et al. ..... 451/388
6,024,631 A * 2/2000 Piper ..... 451/388
6,165,232 A * 12/2000 Tieber et al. ..... 451/388

* cited by examiner

*Primary Examiner*—Robert A. Rose
(74) *Attorney, Agent, or Firm*—Rader, Fishman & Grauer, PLLC

(57) ABSTRACT

Disclosed is a CSP plate holder for use in dicing a CSP plate into individual pellets and in transporting and putting them in a transport tray. The CSP plate holder is composed of a flat plate for sucking and fixedly holding a CSP plate thereon. The flat plate has pellet areas each allotted to each of the individual pellets. Each pellet area has a through hole for sucking and fixedly holding the pellet while the CSP plate is being diced. Each pellet area has at least one suction hole for sucking and fixedly holding the pellet while the CSP plate is being transported. The flat plate has duct passages permitting the suction holes to communicate with a suction source for applying a suction force to the pellet. In addition, the flat plate has at least one minute through hole made in each pellet area.

10 Claims, 9 Drawing Sheets

FIG. 7A

Contents of the First Memory Means

| Identification Number of CSP Plate | Identification Number of CSP Plate | Identification Number of CSP Plate | Identification Number of CSP Plate |
|---|---|---|---|
| 001 | | | |

FIG. 7B

Contents of the Second Memory Means

| Identification Number of CSP Plate | Identification Letters and the Number of Identification Holes of Jig Holders | Addresses of Jig Holders | Pellet Sizes and Other Particulars |
|---|---|---|---|
| 001 | A, 3 | 1 - 1<br>1 - 2<br>1 - 3<br>1 - 4 | 10 mm square<br>4 (lateral divisions)<br>8 (longitudinal divisions) |
| 002 | B, 2 | 2 - 1<br>2 - 2<br>2 - 3<br>2 - 4 | 5 mm square<br>6 (lateral divisions)<br>14 (longitudinal divisions) |
| 003 | C, 1 | 3 - 1<br>3 - 2<br>3 - 3<br>3 - 4 | |
| 004 | D, 0 | 4 - 1<br>4 - 2<br>4 - 3<br>4 - 4 | |

FIG. 7C

Contents of the Third Memory Means

| Results of Detection |
|---|

CSP PLATE HOLDER

BACKGROUND OF THE INVENTION

1. Field of the Invention

The present invention relates to a system for dicing a CSP plate into pellets and for transporting and putting them into a transport tray, and more particularly a CSP plate holder to be used therein.

2. Related Arts

Referring to FIG. 15, a CSP (abbreviated for "Chip Size Package") plate 200 is composed of a plurality of semiconductor chips hermetically sealed and packaged with glass or epoxy resin as a whole. The CSP plate chip can be cut crosswise along the crossing lines 201 and 202 into individual CSPs of same size as a semiconductor. These CSPs are transferred to a transport tray for shipping, or they are transported to an assembling line in the factory to be built in printed circuit boards. Thus, small-sized electronic devices such as notebook-sized personal computers, cellular phones and such like can be provided.

A CSP plate 200 can be diced crosswise to individual pellets by using a dicing machine. Referring to FIG. 16, each CSP plate 200 is fixedly held to a frame F with the aid of adhesive tape T, and the CSP plate thus held can be diced as it is.

A plurality of CSP plate-and-frame combinations are laid on each other to form a stack, and the stack is put in a cassette. After the CSP plate has been diced, the diced CSP plate is still held on the frame, and the diced CSP plate-and-frame combination is put in the cassette. All CSP plates are cut into individual pellets, and then they are transported to the pick-up station where pellets are picked up from a selected diced CSP plate for transferring and putting one by one in a selected transport tray. The transport tray thus loaded with pellets are shipped or brought to an assembling line in the factory.

Apart from the dicing work, it is necessary that CSP plates 200 are fixedly held to frames F with the aid of adhesive tapes T. Before completing this, the dicing work cannot start, and accordingly the productivity is lowered. Also, extra apparatus need to be provided for applying tapes T both to frames F and CSP plates 200, and installation of such extra apparatus is disadvantageous from the economical point of view.

After picking up pellets from diced CSP plate-and-frame combinations, it is necessary that: used adhesive tapes T are peeled off from the frames F; new adhesive tapes T are applied to the frames F; and finally new CSP plates 200 are put on the tapes T. Specifically used frames F are collected to peel their adhesive tapes off, and new adhesive tapes are applied both to the frames F and the CSP plates 200. This work must be begun after finishing the pick-up work, and must be finished before resuming the dicing work. This is a cause for preventing the productivity from being improved. In addition, lots of used adhesive tape must be thrown away, causing a significant pollution in the surrounding.

SUMMARY OF THE INVENTION

What is aimed at by the present invention is to dice a CSP plate into pellets at an increased efficiency without causing any pollution in the surrounding.

To attain this object according to the present invention, a CSP plate holder for use in dicing a CSP plate into individual pellets and in transporting and putting them in a transport tray comprises: a flat plate for bearing a CSP plate thereon, said flat plate having a plurality of pellet areas each allotted to each of the individual pellets, each pellet area having a through hole made therein for sucking and fixedly holding the pellet, said flat plate having engagement means for holding said CSP plate while being transported.

The CSP plate holder can be used repeatedly, not producing any disposables which may cause pollution in the surrounding. Collection of used tapes and application of new tapes both to CSP plates and associated frames are not required, and accordingly the productivity can be improved.

The engagement means may comprise at least one suction hole made adjacent to the through hole in each pellet area for sucking and fixedly holding the pellet while the CSP plate is transported, and duct passages permitting the suction hole to communicate with a suction source for applying negative pressure to the pellet.

With this arrangement the CSP plate can be fixedly held by applying negative pressure to the CSP plate via the through holes while being diced, and by applying negative pressure to the diced CSP plate via the suction holes while being transported.

The flat plate may have at least one minute through hole made in each pellet area, thereby permitting the minute through hole to be selectively used in picking up the pellet for transporting to the transport tray. With this arrangement the pick up of each pellet is facilitated.

The CSP plate holder may comprise further an elastomeric sheet laid on said flat plate. Use of such an elastomeric sheet assures that a CSP plate be held in stable condition even though the CSP plate is somewhat bent. The elastomeric sheet may be of a synthetic resin.

The elastomeric sheet may be applied to the flat plate by an adhesive agent, which is sensitive to ultraviolet rays for reducing its adhesive power. Thus, removal of the elastomeric sheet is facilitated.

Other objects and advantages of the present invention will be understood from a CSP plate holder and a table for bearing the same according to preferred embodiments of the present invention, which are shown in accompanying drawings.

BRIEF DESCRIPTION OF THE DRAWING

FIGS. 7A, 7B and 7C show contents of the first, second and third memory means of the decision making system;

DETAILED DESCRIPTION OF PREFERRED EMBODIMENT

Figure 1:
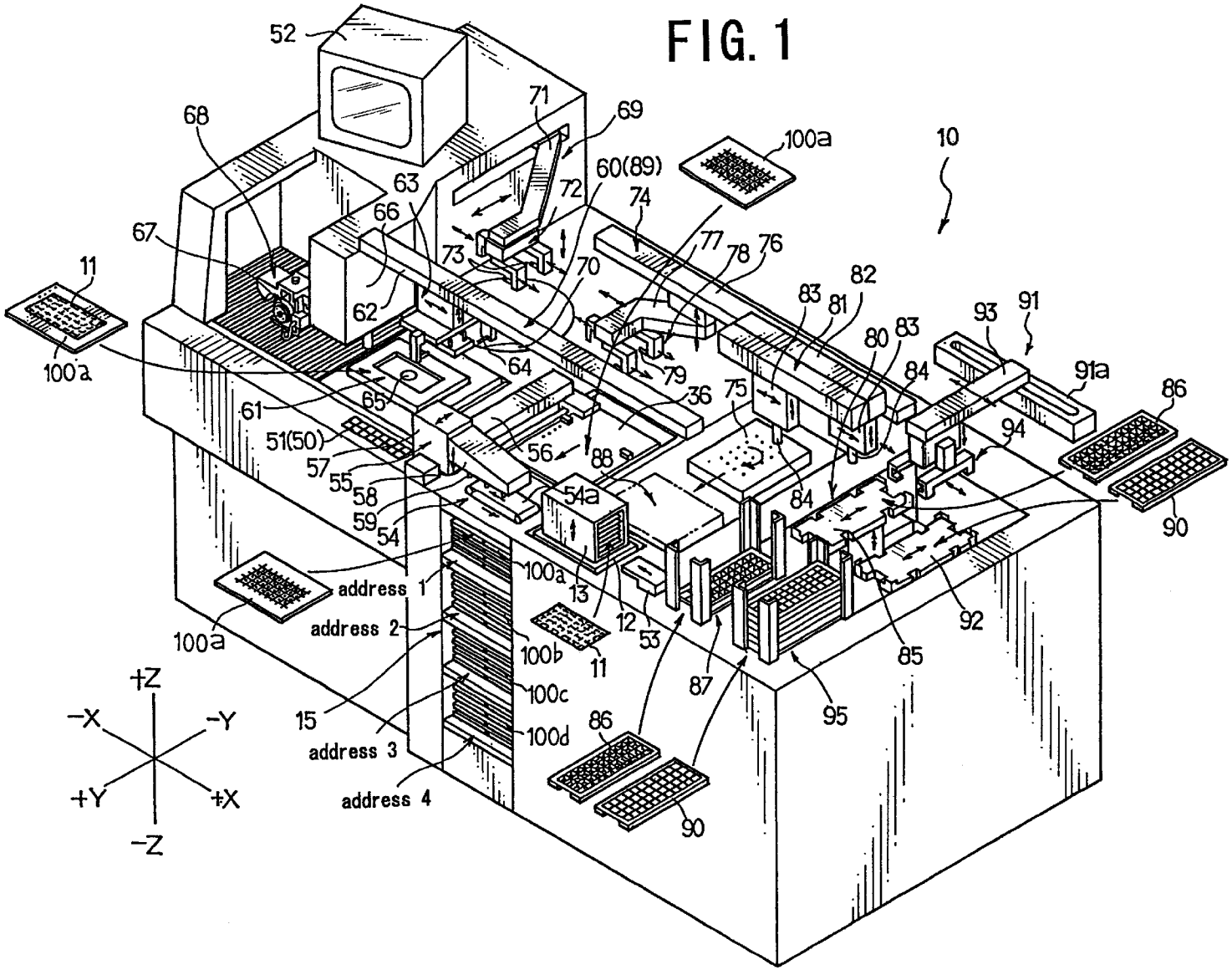
FIG. 1 is a perspective view of a dicing machine in which CSP plate holders according to the present invention are used.

CSP plate holders according to the present invention are described as being used in a dicing machine 10 as shown in FIG. 1. In the dicing machine 10, each CSP plate is diced into individual CSPs, which are transported to and put in a transport tray. CSP plates 11 are laid on each other to form a stack. The stack of CSP plates are put in the cassette 13, which is put on the cassette bearing table 12. It can be raised or lowered.

The holder rack 15 contains a plurality of different types of CSP plate holders, each of which can support an overlying CSP plate while being diced. Two or more different types of CSP plate holders are prepared to meet different types of CSP plates; these CSP plates are different in size and thickness, and have different numbers of pellets arranged in lattice. The CSP plate holders, therefore, must have different lattices of "let-in" grooves in conformity with the different crosswise arrangements of pellets of different type CSP plates. Such "let-in" grooves allow the cutting blade to enter when cutting the CSP plate into pellets. In FIG. 1 four pieces each of the four types of CSP plate holders 100*a*, 100*b*, 100*c* and 100*d* are put in different shelves given addresses of Nos. 1, 2, 3 and 4 in the holder rack 15.

Figure 2:
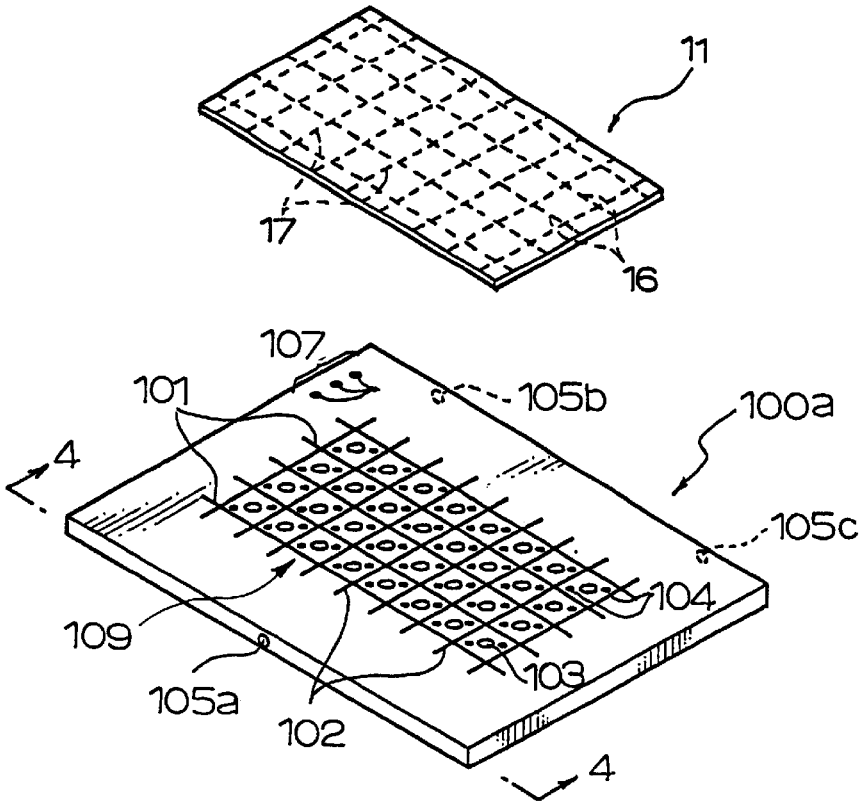
FIG. 2 illustrates one example of CSP plate and an associated CSP plate holder according to a first embodiment of the present invention.

Referring to FIG. 2, the. CSP plate 11 is a flat plate having crosswise cutting lines 16 and 17 to separate into CSPs or pellets. The CSP plateholder 100*a* is so made that the CSP plate 11 may be fixedly held on its rear side, and that each and every CSP may be fixedly held after the CSP plate 11 is diced. Specifically, the CSP plate holder 100*a* has a plurality of sections defined by its crosswise grooves 101 and 102, corresponding to the crosswise cutting lines 16 and 17 of the overlying CSP plate 11, and each section has a single through hole 103 (3 to 5 millimeters in diameter) and two suction holes 104 of less diameter. These apertured sections make up together a CSP plate bearing area.

Figure 3:
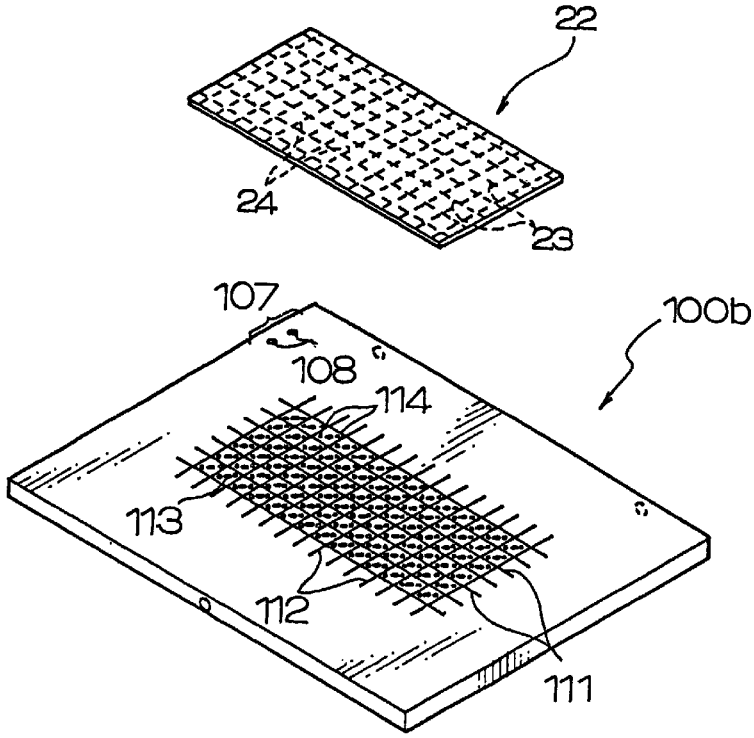
FIG. 3 illustrates another example of CSP plate and an associated CSP plate holder according to the first embodiment of the present invention.

Referring to FIG. 3, a CSP plate 22 has an increased number of crosswise cutting lines 23 and 24, and accordingly an increased number of sections defined thereby. As a matter of course, a CSP plate holder 100*b* to be combined with such a CSP plate 22 has a corresponding increased number of crosswise grooves 111 and 112, accordingly an increased number of sections defined thereby. The numbers of the through holes 113 and suction holes 114 are increased accordingly.

Figure 4:
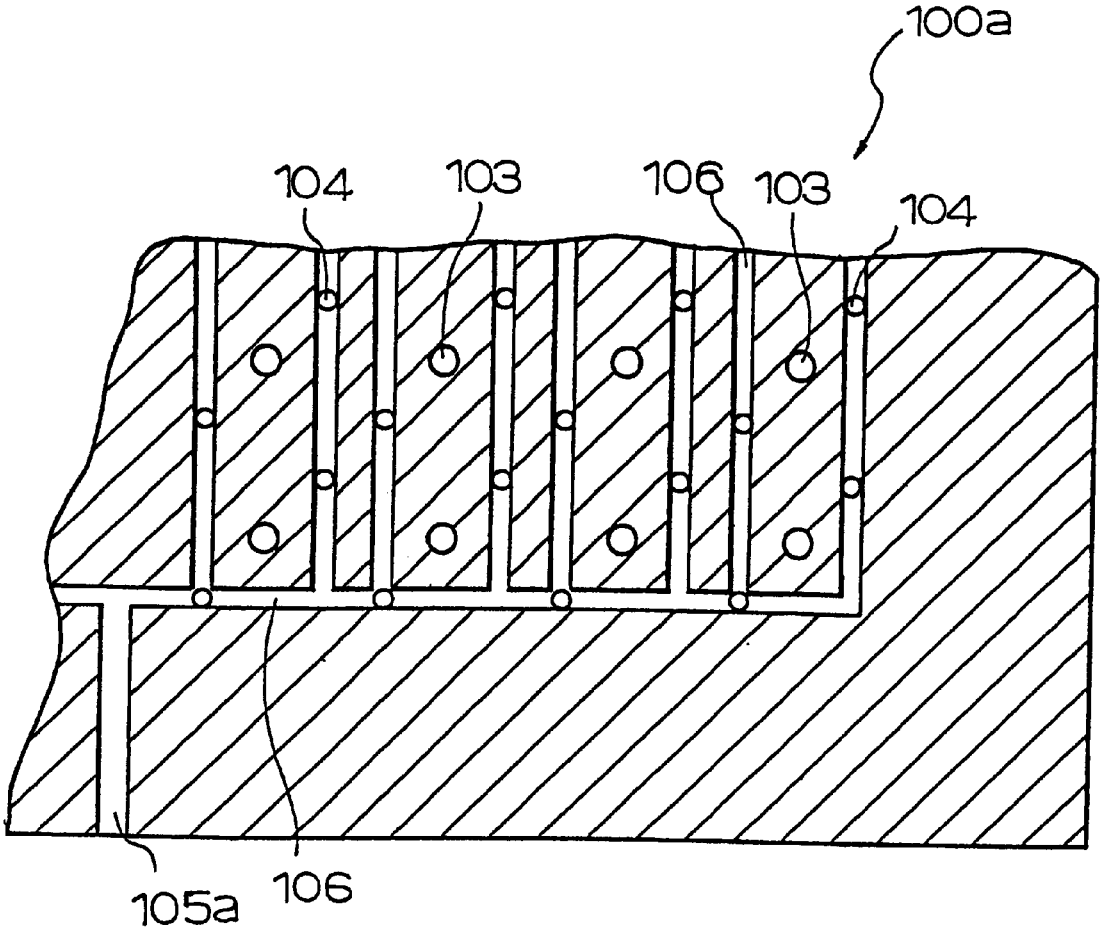
FIG. 4 is a sectional view of the CSP plate holder taken along the line 4—4 in FIG. 2.

Referring to FIG. 2 again, the CSP plate holder 100*a* has three engagement holes 105*a*, 105*b* and 105*c* made on its longitudinal sides. The suction pipes 64, 73 and 79 of the first, second and third transport means 60, 69 and 74 can be inserted in these engagement holes 105*a*, 105*b* and 105*c* respectively. Referring to FIG. 4, the through holes 103 pass through the thickness of the plate 100*a* from the front to rear side whereas the suction holes 104 for the plate sucking-and-transporting use communicate with the three engagement holes 105*a*, 105*b* and 105*c* via the duct passages 106, which are made in the thickness of the plate 10*a*.

Each CSP plate holder has an identification mark 107 formed on its front. For example, the identification mark 107 is given in the form of the particular number of through holes. In FIG. 2 the CSP plate holder 100*a* has three through holes 108 made therein. In FIG. 3 the CSP plate holder 100*b* has two through holes 108 made therein. Bar codes may be used as an identification mark.

Referring to FIGS. 5A to 5D, the CSP plate holder putting in-and-taking out unit 35 comprises an upright wall 37 having an "L"-shaped stage 39 vertically movable thereon, and a CSP plate holder putting in-and-taking out table 36 horizontally movable on the cantilever-like extension of the "L"-shaped stage 39. The upright wall 37 has a vertical slot 40 and two parallel vertical rails 38 laid on the opposite sides of the vertical slot 40. The "L"-shaped stage 39 has a rear projection formed on its dependent extension. The rear projection has a tapped hole made thereon, and the rear projection is slidably fitted in the vertical slot of the upright wall 37. The upright wall 37 has a motor drive 41 placed at its top, and a screw rod is integrally connected to the shaft of the motor drive 41, extending downward on the rear side of the upright wall 37 to be threadedly engaged with the tapped hole of the rear projection of the "L"-shaped stage 39. Thus, clockwise or counter clockwise rotation of the shaft of the motor drive 41 will raise or lower the "L"-shaped stage 39 on the upright wall 37.

A CSP plate holder putting in-and-taking out table 36 rides on two parallel rails 42, which are laid on the cantilever-like extension of the "L"-shaped stage 39. As shown, the cantilever-like extension has a drive 36a attached to one corner for driving the table 36 back and forth within a certain limited range in the ±Y-axial direction on the cantilever-like extension of the "L"-shaped stage 39. Also, the table 36 has detecting means 46 for detecting the identification mark 107, which is formed in the CSP plate holder. In this particular embodiment, the detecting means 46 comprises four photo-generative and photo-receptive semiconductor elements 43. These photo-sensors can be used in making a decision as to whether a CSP plate holder to be taken out is appropriate for use in holding a selected CSP plate to be diced.

In taking out an appropriate CSP plate holder 100*a* from the rack 15, the "L"-shaped stage 39 is raised or lowered until it has come to a level given the address searched and found beforehand, and then, the stage 39 is lowered somewhat below the level. Then, the table 36 is moved in the +Y-axial direction to be laid under the CSP plate holder 100*a* in the rack 15 (see FIG. 5B), and a decision is made as to whether the overlying holder is appropriate for holding the selected CSP plate to be diced.

Figure 6:
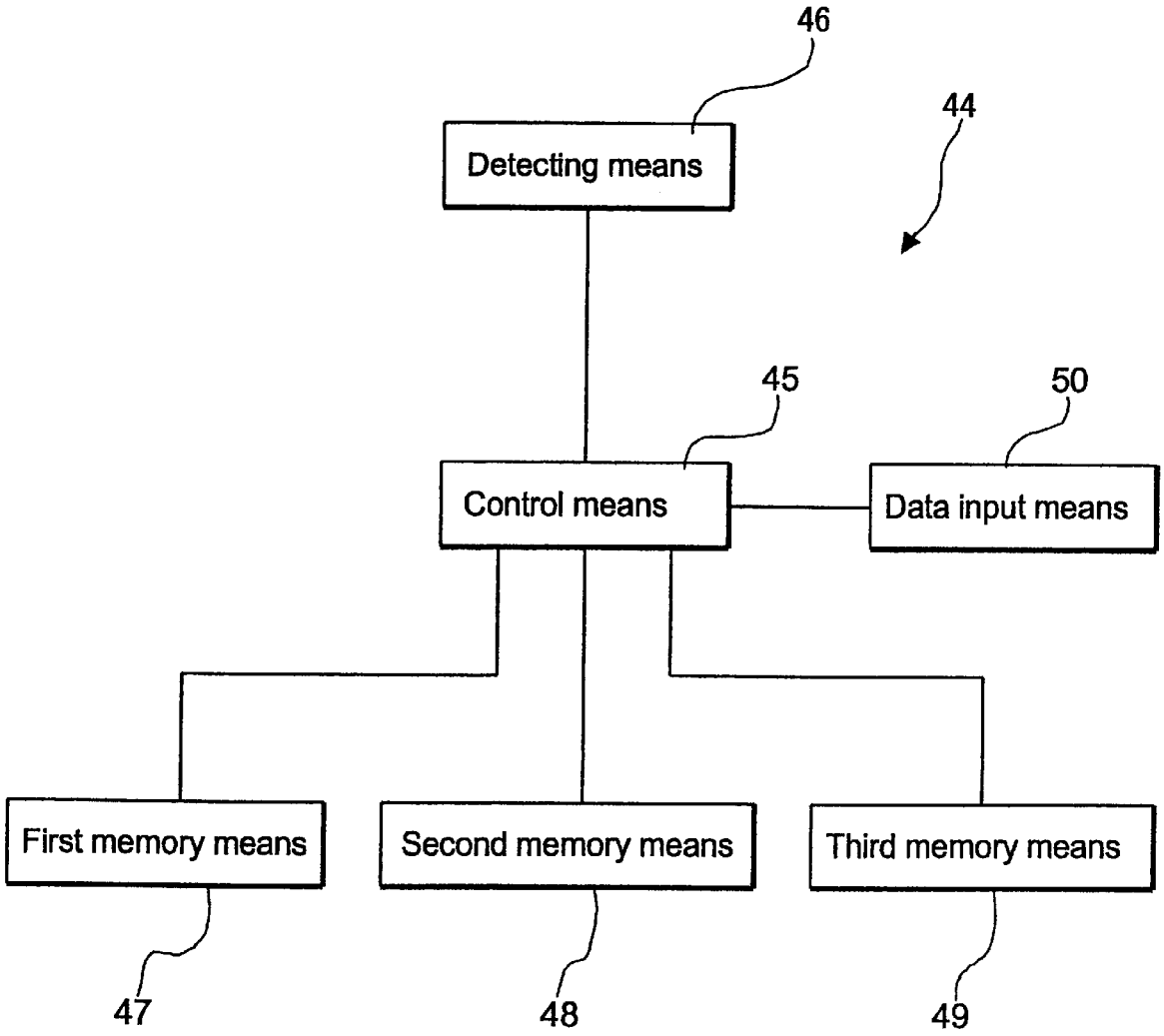
FIG. 6 is a block diagram of a decision making system which can make a decision as to whether or not a selected CSP plate holder is appropriate for holding a selected type of CSP plate.

Referring to FIG. 6, the decision-making unit 44 comprises a data input means (console) 50 for inputting pieces of information, a control means (CPU) 45, and first, second and third memory means 47, 48 and 49.

The control means 45 permits the storing of selected pieces of information from the data input means 50 in one of these memory means, and the retrieving from the memory means, and the control means makes a required comparison between pieces of information retrieved from different memory means and a required decision on the basis of such comparison.

The detecting means 46 is composed of the photo-sensors 43 in the CSP plate holder putting in-and-taking out table 36 (see FIG. 5) if the identification mark 107 is given in the form of holes, and is composed of a barcode reader if the identification mark 107 is given in the form of barcode.

Specifically, an operator stores the identification number of CSP plates 11 to be diced in the first memory means 47 by using the data input means 50. The identification number is a three-digit number varying with the size and thickness of the plate, the size of pellets and such like. In this particular example the identification number is 001, and is stored in the first memory means 47, indicating that a selected CSP plate whose identification number is 001 is to be diced, as seen from FIG. 7A.

As seen from FIG. 7B, the second memory 48 stores identification numbers of different types of CSP plates, identification letters of associated jig holders and the number of identification holes; addresses of jig holders in the rack; pellet sizes and such like, as for instance follows: the identification letter of the type of jig holder to be associated with a CSP plate whose identification number is 002 is B; such type of jig holders are stored at the addresses 2-1, 2-2, 2-3 and 2-4 in the rack 15; the pellet size of the 002 CSP plate is 5 millimeter square, and the CSP plate can be divided into 6 (longitudinal divisions) times 14 (lateral divisions).

The detecting means 46 detects the identification holes 107 of the CSP plate holder which is about to be taken out by the putting in-and-taking out table 36. The number of the identification holes along with the identification letter are stored in the third memory means 49, as seen from FIG. 7C.

The data input means 50 in the form of console 51 is positioned on the front side of the dicing machine 10, and it is used in putting pieces of information in the first and second memory means 47 and 48.

First, the operator inputs in the first memory means 47 the identification number 001 of a selected CSP plate 11 to be diced.

Figure 5A:
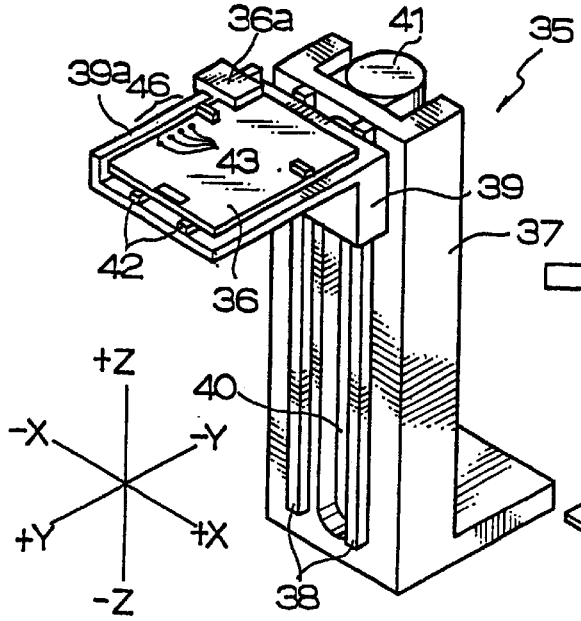
FIGS. 5A to 5D illustrate how a selected CSP plate holder can be taken out from the rack.
Figure 5B:
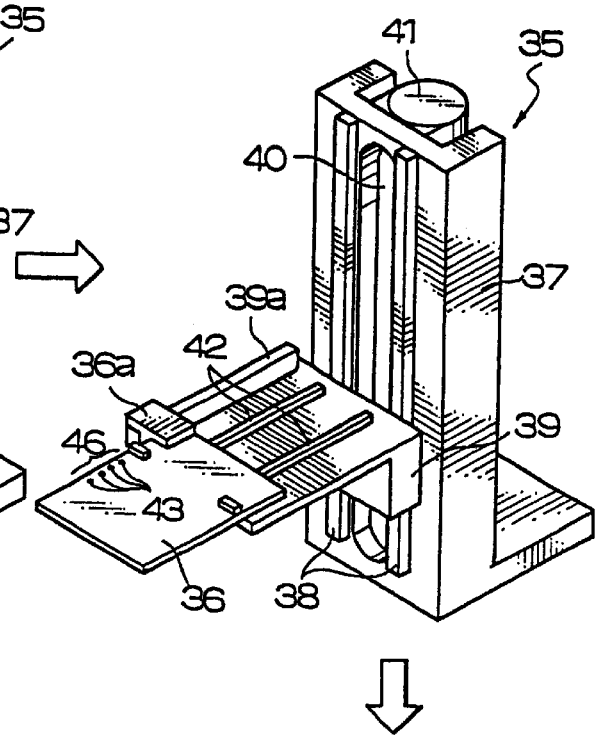
Figure 5D:
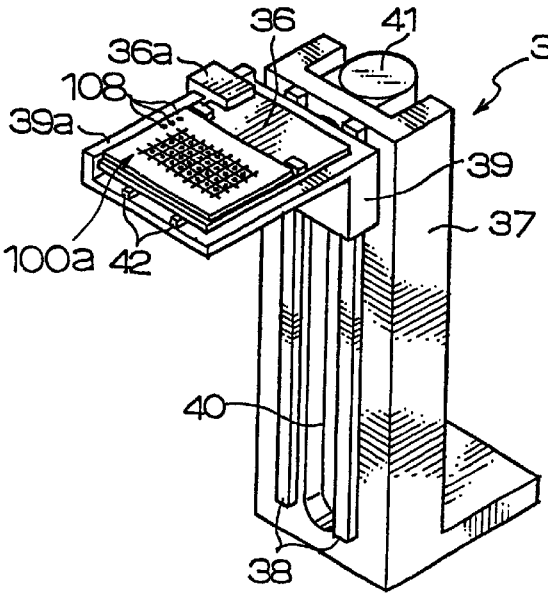

After finding which address in the rack a required CSP plate holder is located by referring to the content of the second memory, the putting in-and-taking out table 36 is moved to the address thus found, and then the putting in-and-taking out table 36 is made to advance under the CSP plate holder 100*a* (identification letter A) in the rack 15, as seen from FIG. 5B. The identification holes of the CSP plate holder 100*a* are detected by the detector 46, and the number of the so detected identification holes is stored in the third memory 49.

Specifically the photogenerative semiconductor elements 43 project beams of light to the holes 108 of the overlying holder 100*a*. The beam of light directed to the hole-less area is reflected from the rear side of the holder 100*a* whereas the other beams of light directed to the holes 108 are not reflected from the holder 14*a*. Thus, the photo-sensors 43 can determine how many holes 108 are made on the holder 100*a* in terms of the reflected beam of light, as for instance follows:

assuming that the CSP plate holder 100*a* of identification letter A has three holes 108 made therein; the CSP plate holder 100*b* of identification letter B has two holes 108 made therein; the CSP plate holder 100*c* of identification letter C has one hole made therein; and the CSP plate holder 100*d* of identification letter D has no hole made therein; and assuming that the holder 100*a* of identification letter A is above the putting in-and-taking out table 36, three reflected beams of light are of least strength, and one reflected beam of light is of good strength, thus identifying the overlying holder as the one of identification letter A. The detection result is stored in the third memory means 49.

The control means 45 makes a decision as to whether the contents of the first and third memory means 47 and 49 meet the CSP-to-jig correspondence relationship stored in the second memory means 48. Specifically the identification number of the CSP plate stored in the first memory means 47 is 001 whereas the identification letter of the CSP plate holder stored in the third memory means 49 is A. Then, the CSP-to-holder correspondence relationship stored in the second memory means 48 is satisfied, so that the CSP plate holder 100*a* lying above the putting in-and-taking out table 36 is determined to be appropriate for holding the CSP plate 001.

Figure 5C:
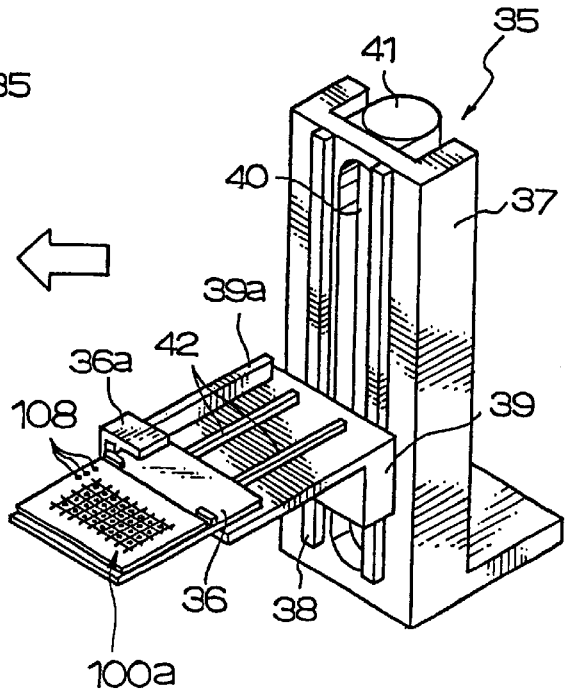

Thus, the putting in-and-taking out table 36 is raised to bear the jig holder 14*a*, as seen from FIG. 5C. The putting in-and-taking out table 36 is moved in the −Y-axial direction to take out the CSP plate holder 100*a* from the rack 15, and then, the putting in-and-taking out table 36 is raised up to the highest level (see FIG. 5D), permitting the putting in-and-taking out table 36 to appear on the dicing machine 10.

In case that the contents stored in the first and third memory means 47 and 49 fail to satisfy the CSP-to-holder correspondence relationship stored in the second memory means 48, the CSP plate holder lying above the table 36 is determined to be inappropriate for holding the CSP plate 001, and then the fact thus confirmed is given in the display 52 without taking out the CSP plate holder-from the rack 15.

Even if a wrong CSP plate holder is stored in the address to which the putting in-and-taking out table 36 has an access, the taking out of the wrong holder can be avoided by allowing the decision-making means 44 to confirm that the holder does not meet the CSP-to-holder correspondence relationship relative to the selected CSP plate 11.

Thus, the correct CSP plate holder 100*a* is put on the putting in-and-taking out table 36. On the other hand, a selected CSP plate 11 is taken out from the cassette 12 by moving the CSP plate carrier 53 in the X-axial direction, putting the CSP plate 11 on the tentative storage station 54.

In the tentative storage station 54 the conveyer belt 54*a* runs in the −X-axial direction, carrying the selected CSP plate 11 to a predetermined position where the CSP plate transporting means 55 transports the CSP plate 11 to the CSP plate holder 100*a*, which is laid on the putting in-and-taking out table 36.

Figure 8:
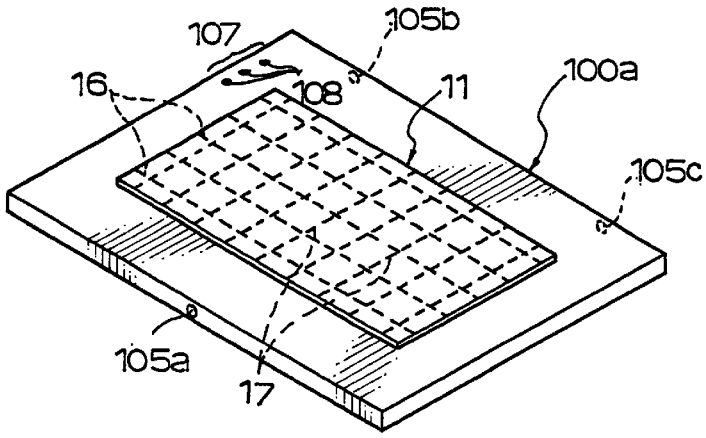
FIG. 8 is a perspective view of a CSP plate-and-CSP plate holder combination.

As shown in FIG. 1, the CSP plate transporting means 55 comprises a third guide rail 56 extending in the Y-axial direction, a drive 57 running on the guide rail 56 and an up-and-down unit 58 fixed to the drive 57. The up-and-down unit 58 has suction means 59. The up-and-down unit 58 is lowered to suck and hold the CSP plate 11 in the tentative storage station, and then, the up-and-down unit 58 is raised and moved in the −Y-axial direction to bring the CSP plate 11 to the jig holder 14*a* above. The up-and-down unit 58 is lowered to release the CSP plate 11 onto the jig holder 14*a* (see FIG. 8).

Thus, the CSP plate 11 is put on the CSP plate holder 100*a*, which is laid on the putting in-and-taking out table 36, and then, the CSP plate 11 along with the holder 100*a* are transported to the working table 61 by the first transport means 60.

The first transport means 60 is composed of an elongated cantilever-like extension 62 and a gripper 63 movable along the cantilever-like extension 62 in the X-axial direction and vertically in the Z-axial direction. The gripper 63 has three suction pipes 64 for holding the CSP plate holder 100*a*.

These suction pipes 64 are applied to the engagement holes 105*a*, 105*b* and 105*c* of the CSP plate holder 100*a* as shown in FIG. 2. Negative pressure is applied to the overlying CSP plate 11 via the duct passages 106 and the second suction holes 104 to hold fixedly the CSP plate 11 on the CSP plate holder 100*a* by suction. Thus, the CSP plate 11 is fixedly gripped and brought by the gripper 63 to the working table 61 above. The gripper 63 is lowered toward the working extension 76 in the X-axial direction and vertically in the Z-axial direction, and a gripper 78 attached to the end of the arm 77. As is the case with the first and second transport means 60 and 69, the gripper 78 has three suction pipes 79 to engage with the engagement holes 29, 30 and 31 of the CSP plate holder 100*a* for sucking and holding a diced CSP plate-and-holder combination.

When the diced CSP plate-and-holder combination is transported to the CSP plate bearing table 75 above by the gripper 78, the gripper 78 is lowered while the suction pipes 79 are put away from the engagement holes 105*a*, 105*b* and 105*c*, thus landing and leaving the diced CSP plate-and-holder combination on the CSP plate bearing table 75.

The CSP plate bearing table 75 can be moved in the Y-axial direction, and can be rotated, also. The CSP plate bearing table 75 is moved in the Y-axial direction to put the diced CSP plate-and-holder combination in position appropriate for picking up pellets one by one.

Transport trays are stored in the transport tray storage area 80 ahead of the CSP plate turning table 75 in the +X-axial direction. The pick up-and-transport means 81 extends from the CSP plate bearing table 75 to the transport tray storage area 80 above.

The pick-up and-transport means 81 comprises two movable pellet-suction means each movable both in the X-axial and Z-axial directions, each carrying a selected pellet and an elongated guide 82 which guides each movable pellet-suction means in the X-axial direction while it travels on the way from the CSP plate bearing table 75 to the transport tray station 80.

The first transport tray bearing table 85 bears an empty transport tray 86. The table 85 can be raised and lowered in the Z-axial direction, and can be moved in the Y-axial direction to crawl under the first transport tray rack 87, in which a plurality of empty transport trays 86 are laid on each other to form a stack, and the lowermost transport tray is taken out by the table 85. Then, the table 85 bearing an empty transport tray 86 returns to the transport tray storage area 80.

To pick up and transfer each pellet from the diced CSP plate to a transport tray 86 the CSP plate bearing table 75 is moved in the Y-axial direction until the diced CSP plate-and-holder combination has been put in position in which a selected pellet is put below either gripper 83. Then, the gripper 83 is lowered to suck the selected pellet, and the gripper 83 is raised. table 61 while putting the suction pipes 64 apart from the engagement holes 29, 30 and 31, thus allowing the CSP plate-and-holder combination to land and stay on the working table 61. Then, negative pressure is applied to the CSP plate 11 via the first suction holes 103, thereby holding fixedly the CSP plate-and-holder combination on the working table 61.

Then, the working table 61 is moved in the −X-axial direction to the alignment means 66 below to detect the cutting lines 16 on the CSP plate 11, so that the CSP plate 11 may be aligned with the cutting blade 67 in the Y-axial direction.

Movement of the working table 61 in the −X-axial direction permits the cutting blade 67 of the cutter means 68 to cut the CSP plate 11 along a selected longitudinal cutting line 16. Every time the CSP plate has been cut along each longitudinal cutting line 16, the CSP plate 11 is displaced the line-to-line interval distance in the Y-axial direction, and the working table 61 is reciprocated in the X-axial direction. Thus, the CSP plate 11 is cut along each and every longitudinal cutting line 16.

Then, the working table 61 is rotated 90 degrees to permit the sequential cutting along each and every lateral cutting line 17, thus dicing the CSP plate.

The diced CSP plate-and-holder combination is transported to the cleaning table 70 by the second transport means 69. The second transport means 69 is composed of a movable arm 71 having an up-and-down grip 72 attached to its tip end. The movable arm 71 can be moved both in the X- and Y-axial directions, and the up-and-down grip 72 can be raised and lowered. The up-and-down grip 72 has three suction pipes 73 to be applied to the engagement holes 29, 30 and 31 of the CSP plate holder 100*a*.

The washing table 70 is substantially same as the working table in structure. It is a turn table having suction holes. When a CSP plate-and-holder combination is put on the washing table, it is rotated and exposed to the jet of washing water to remove minute pieces of debris from the upper surface of the diced CSP plate 11. Finally it is dried by blowing air.

After being washed and dried, the diced CSP plate-and-jig holder combination is transported to the CSP plate table 75 by the third transport means 74. The third transport means 74 is composed of a bridge-like extension 76 extending in the X-axial direction, an arm 77 movable along the bridge-like.

On the other hand, the transport tray 86 advances in the Y-axial direction in unison with the stepwise-movement of the first transport tray bearing table 85 in the Y-axial direction, so that the transport tray 86 may be aligned with the gripper 83 in the X-axial direction. Then, the gripper 83 gripping the selected pellet is moved in the +X-axial direction to transfer a selected pellet to a selected cell in the transport tray 86 above, and the gripper is lowered to release the selected pellet to the allotted cell.

The proceeding above described is repeated until all cells of the transport tray have been occupied by the pellets. In this particular embodiment two grippers 83 work in parallel efficiently.

After picking up all pellets, the CSP plate holder 14*a* is left on the CSP plate bearing table 75, and then, the table 75 is made to turn 90 degrees, moving to the CSP plate holder storage area 88 in the +Y-axial direction. The fourth transport means 89 carries the holder 100*a* to the putting in-and-taking out table 36. Then, another CSP plate is put on the CSP plate holder 100*a* to resume the dicing and transporting work.

When all CSP plates are diced and transported, the CSP plate holder 100*a* is returned to the CSP plate holder rack 15 to be pigeonholed at its original address. Advantageously the CSP plate holder 100*a* can be repeatedly used. In practice, four holders can be used simultaneously by moving them in unison.

The transport tray 90 thus filled with pellets is transferred to the second transport bearing able 92 by the transport means 91. As shown in FIG. 1, the transport means 91 comprises a guide rail 91*a*, a transverse arm 93 movable along the guide rail 91*a* in the X-axial direction, and a pinch unit 94 fixed to the end of the transverse arm 93. The pinch unit 94 is lowered to hold the pellet-filled transport tray 90, and the pinch unit 94 is raised and moved in the +X-axial direction to carry the transport tray 90 to the second transport tray bearing table 92 above. The pinch unit 94 is lowered to release the transport tray 90 to the second tray bearing table 92.

The second tray bearing table 92 can be moved both in the Y- and Z-axial directions inside the dicing machine. The table 92 is moved to the second transport tray rack 95 below, inserting the new pellet-filled transport tray into the bottom of a stack of pellet-filled transport trays in the second transport tray rack 95.

As may be understood from the above, the dicing and transporting machine effects the dicing of each CSP plate, the washing of each diced CSP plate, the picking up of each pellet and the loading of transport trays with pellets. Thus, the series of works can be performed at an increased efficiency, and such machine is advantageous from the economical and productivity point of view.

A CSP plate can be sucked and fixedly held by an associated CSP plate holder simply by applying negative pressure from the suction sources 64, 73 and 79 to the overlying CSP plate via its engagement holes 105*a*, 105*b* and 105*c*. There is no fear of allowing the CSP plate to fall on the way to a selected destination.

Figure 9:
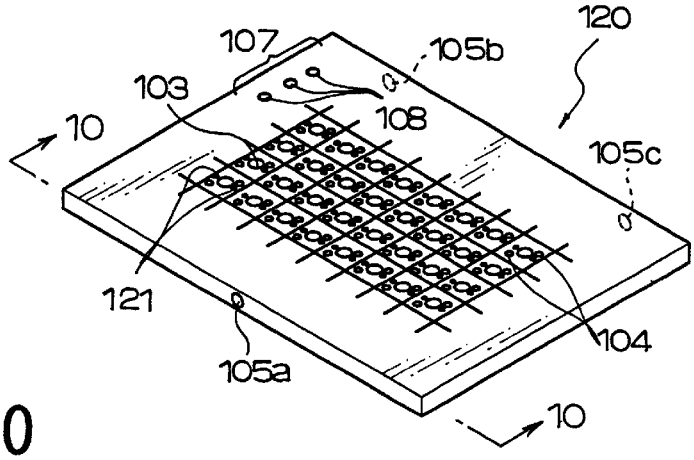
FIG. 9 is a perspective view of a CSP plate holder according to a second embodiment of the present invention.

Referring to FIG. 9, a CSP plate 120 according to the second embodiment of the present invention is different from the CSP plates 100*a* and 100*b* of FIGS. 2 and 3 only in that it has two minute through holes 121 made in each square section.

As described earlier, the CSP plate can be fixedly held by applying negative pressure from the suction sources 64, 73 and 79 to the overlying CSP plate via the engagement holes 105*a*, 105*b* and 105*c* of the CSP plate while it is being diced or washed.

When pellets are picked up from a diced CSP plate one after another, and when each pellet is fixedly held by applying negative pressure from a selected through hole 103, the through holes 103 are allowed to be exposed to the atmosphere one after another every time one pellet has been removed from the diced CSP plate. As a result, the surrounding air is allowed to be drawn from the open through holes, thus accordingly lowered the suction force. As a consequence, it is liable that pellets are allowed to deviate from their correct positions on the CSP plate holder 120, thus making it difficult for the gripper 84 to pick up pellets from the diced CSP plate.

Figure 10:
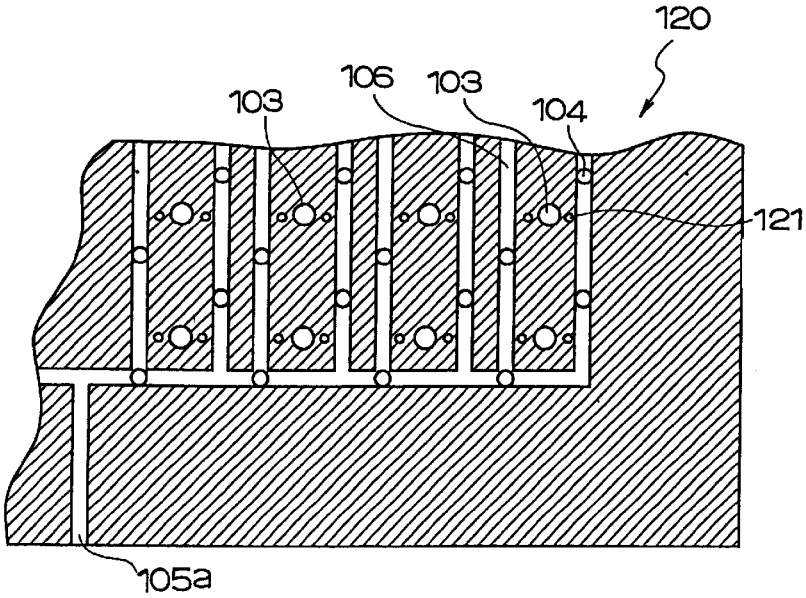
FIG. 10 is a sectional view of the CSP plate holder taken along the line 10-10 in FIG. 9.
Figure 11:
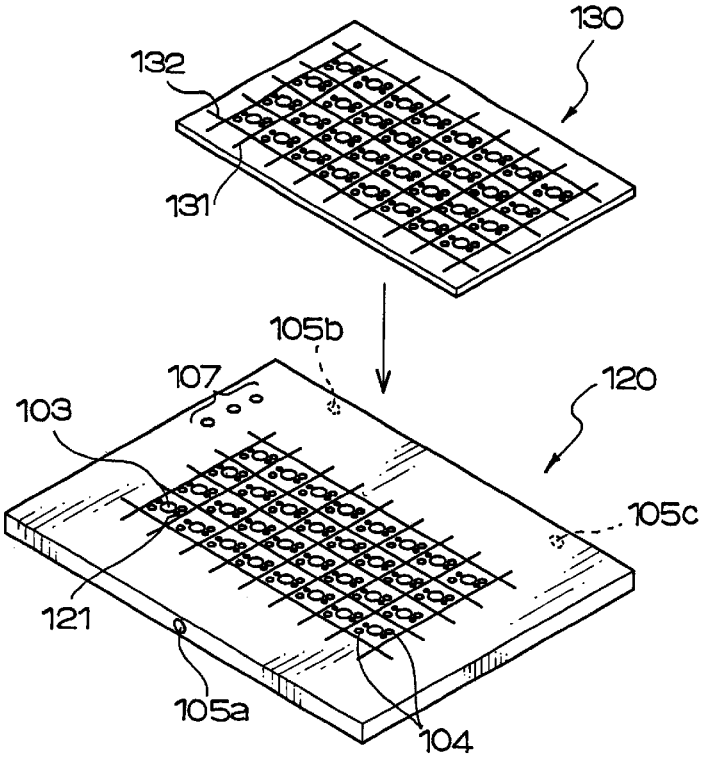
FIG. 11 illustrates a CSP plate holder according to a second embodiment of the present invention, and an associated elastomeric sheet.

Referring to FIG. 10, minute through holes 121 are made to be independent from all of through holes 103 and suction holes 104, and negative pressure can be applied to each pellet via the minute through holes 121 to hold fixedly the pellet when pellets are picked up from the diced CSP plate.

The resultant suction power at the two minute through holes for sucking and holding the overlying pellet must be lower than the suction power applied by the ripper 84 for sucking and removing the pellet from the underlying diced CSP plate. Also, each minute through hole should not draw a significant amount of air from the surrounding to allow the suction power to be reduced. The minute through hole 21 has a very small diameter, preferably ranging from 0.2 to 0.4 millimeters.

Figure 12:
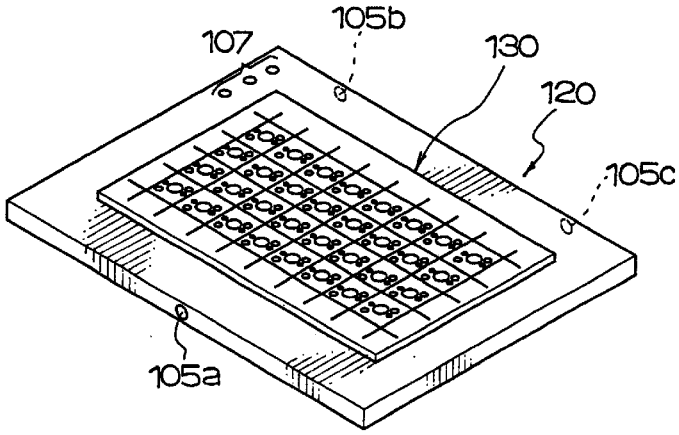
FIG. 12 illustrates a CSP plate holder having an elastomeric sheet laid thereon.
Figure 13:
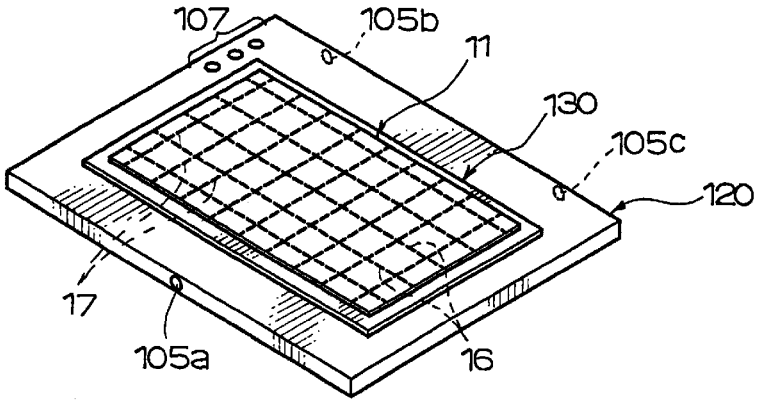
FIG. 13 illustrates a CSP plate holder having an elastomeric sheet and a CSP plate laid thereon.

Some CSP plates may be somewhat bent, and cannot be fixedly held on CSP plate holders. Referring to FIG. 12, rubber or elastomeric sheets 130 are laid on CSP plates 120 to compensate for their bends, thus permitting CSP plates to hold fixedly the overlying CSP plates (see FIG. 13).

The elastomeric sheet 130 has different apertures made in conformity with the through holes 103, suction holes 104 and minute through holes 121 of the overlying CSP plate holder 120, but it is not necessary to cut "in let" grooves because the cutting blade cannot be broken when it conflicts with the elastomeric sheet 130. As a matter of course, such elastomeric sheets can be applied to CSP plate holders 100*a* and 100*b* of FIGS. 2 and 3.

The elastomeric sheet 130 may be applied to the CSP plate holder by an adhesive agent, which is responsive to ultraviolet rays for reducing its adhesive strength. When such elastomeric sheet 130 is deteriorated after repeated use, and when it needs to be changed for a new elastomeric sheet, exposure of the used sheet to ultraviolet radiation will facilitate the peeling-off of used sheet from the CSP plate holder.

To suck and hold each pellet by applying a negative pressure to the pellet via the minute through holes it is necessary that the CSP bearing table be so constructed as to permit application of negative pressure to the pellet through each minute through hole.

Figure 14:
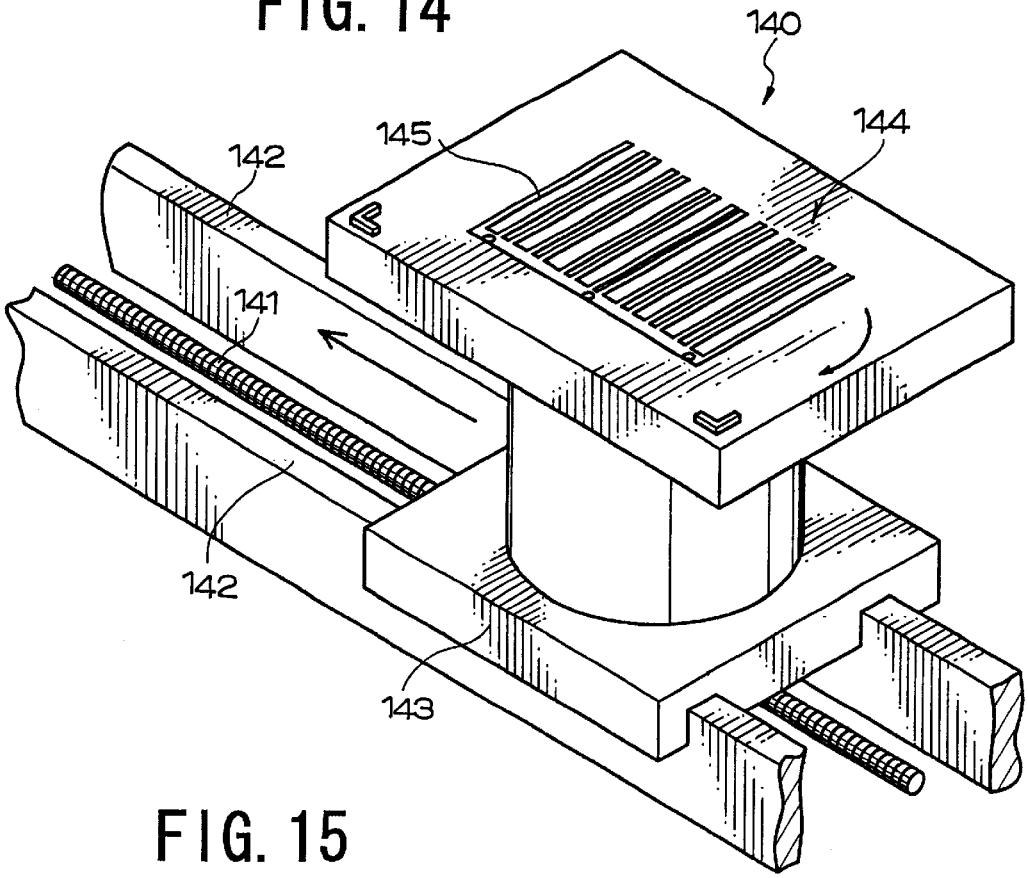
FIG. 14 is a perspective view of a table for bearing a CSP plate holder according to the second embodiment.
Figure 15:
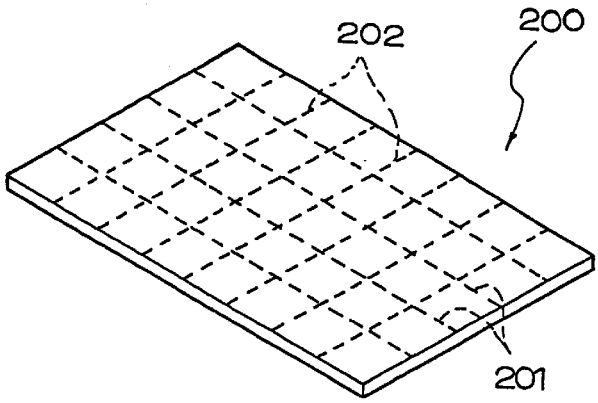
FIG. 15 is a perspective view of a CSP plate.
Figure 16:
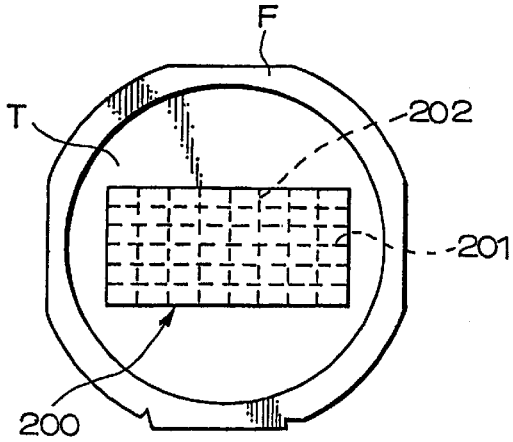
FIG. 16 PRIOR ART
FIG. 16 illustrates a CSP plate-and-frame combination.

Referring to FIG. 14, the CSP bearing table 140 comprises a base 143 and a table 144 fixed to the top of the base 143. The base 143 rides on two parallel guide rails 142. An elongated screw rod 141 is connected to the shaft of an associated electric motor (not shown), extending between the opposite guide rails 142 in the Y-axial direction. The base 143 is threadedly engaged with the screw rod 141, and it can be driven in the Y-axial direction by the electric motor.

As shown, the table 144 has duct passages 145 to communicate exclusively with the minute through holes 121 of the overlying CSP plate holder 120. These duct passages 145 do not communicate with the through holes 103, so that the through holes 103 of the CSP plate holder 120 may be closed when it is put on the table 144. Thus, the diced CSP plate is held by applying a controlled negative pressure to each pellet area via the minute through holes 121, thereby facilitating the picking up of each pellet from the diced CSP plate; each pellet is retained in its correct position, and is sucked and held with a relatively weak suction force.

As may be understood from the above, CSP plate holders according to the present invention can be repeatedly used, and can fixedly hold CSP plates simply by applying negative pressure to them. Thus, any disposable such as adhesive tapes needs to be used, and therefore, removal and collection of used adhesive tapes and application of new adhesive tapes to CSP plates and associated frames are not required. There is, therefore, no problem of pollution, and the productivity can be improved accordingly.

The controlled sucking of CSP plates and diced CSP plates assures the reliable setting and holding of such plates in dicing and; transporting.

Use of elastomeric sheets permits CSP plates even though bent more or less to be fixedly held on the CSP plate holders. Elastomeric sheets may be applied to CSP plate holders with an ultraviolet rays-sensitive adhesive agent, and then used sheets can be easily peeled off to be changed with new ones.

What is claimed is:

1. A CSP plate holder for use in dicing a CSP plate into individual pellets, the CSP plate holder comprising:

a solid block operative for bearing the CSP plate thereon and having a first surface, a second surface disposed opposite the first surface and a thickness extending therebetween in a thickness direction to define a side surface extending about and between the first and second surfaces, the solid block having a plurality of pellet areas formed on the first surface with each pellet area allotted to a respective one of the individual pellets, a plurality of bores extending entirely through the solid block between the first and second surfaces, each bore allotted to a respective one of the pellet areas, a plurality of suction holes formed on the first surface and partially into the solid block with at least one suction hole allotted to a respective one of the pellet areas and a labyrinth of suction passages formed interiorly of the solid block, the labyrinth of suction passages including at least one suction passage opening formed into the side surface and being in fluid communication with each one of the plurality of suction holes and exteriorly of the solid block at the suction passage opening, the plurality of bores, the plurality of suction holes and the labyrinth of suction passages disposed in a manner such that the plurality of the bores are in fluidic isolation from the plurality of suction holes and the labyrinth of suction passages.

2. A CSP plate holder according to claim 1, wherein the solid block includes a plurality of crisscrossing grooves forming a pattern defining the plurality of the pellet areas.

3. A CSP plate holder according to claim 1, wherein solid block includes an identification mark.

4. A CSP plate holder according to claim 1, further comprising an elastomeric sheet laid on the first surface of said solid block.

5. A CSP plate holder according to claim 4, wherein said elastomeric sheet is made of a synthetic resin.

6. A CSP plate holder according to claim 5, wherein said elastomeric sheet is applied to the first surface of said solid block by an adhesive agent, which is sensitive to ultraviolet rays for reducing its adhesive power.

7. A CSP plate holder according to claim 3, wherein the indentification mark is a selected number of identification holes linearly aligned and formed into the first surface.

8. A CSP plate holder according to claim 1, wherein the solid block is rectangularly shaped forming two pairs of opposing sides surfaces and the labyrinth of suction passages extends perpendicularly to the thickness direction.

9. A CSP plate holder for use in dicing a CSP plate into individual pellets, the CSP plate holder comprising:

a flat plate operative for bearing the CSP plate thereon and having a first surface, a second surface disposed opposite the first surface and a thickness extending therebetween in a thickness direction to define a side surface extending about and between the first and second surfaces, the flat plate having a plurality of pellet areas formed on the first surface with each pellet area allotted to a respective one of the individual pellets, a plurality of through holes extending through and between the first and second surfaces, each through hole allotted to a respective one of the pellet areas, a plurality of suction holes formed on the first surface and partially into the flat plate with at least one suction hole allotted to a respective one of the pellet areas and a labyrinth of suction passages formed interiorly of the flat plate, the labyrinth of suction passages including at least one suction passage opening formed into the side surface and being in fluid communication with each one of the plurality of suction holes and exteriorly of the flat plate at the suction passage opening, wherein the flat plate is rectangularly shaped forming two pairs of opposing sides surfaces and the labyrinth of suction passages extends perpendicularly to the thickness direction and wherein the flat plate includes at least two suction openings with one suction opening formed into one side surface of a selected pair of side surfaces and a remaining suction opening formed into an opposing side surface of the selected pair of side surfaces.

10. A CSP plate holder for use in dicing a CSP plate into individual pellets, the CSP plate holder comprising:

a flat plate operative for bearing the CSP plate thereon and having a first surface, a second surface disposed opposite the first surface and a thickness extending therebetween in a thickness direction to define a side surface extending about and between the first and second surfaces, the flat plate having a plurality of pellet areas formed on the first surface with each pellet area allotted to a respective one of the individual pellets, a plurality of through holes extending through and between the first and second surfaces, each through hole allotted to a respective one of the pellet areas, a plurality of suction holes formed on the first surface and partially into the flat plate with at least one suction hole allotted to a respective one of the pellet areas and a labyrinth of suction passages formed interiorly of the flat plate, the labyrinth of suction passages including at least one suction passage opening formed into the side surface and being in fluid communication with each one of the plurality of suction holes and exteriorly of the flat plate at the suction passage opening, wherein the flat plate is rectangularly shaped forming two pairs of opposing sides surfaces and the labyrinth of suction passages extends perpendicularly to the thickness direction and wherein the flat plate includes three suction openings with two suction openings formed into one side surface of a selected pair of side surfaces and a remaining suction opening formed into an opposing side surface of the selected pair of side surfaces.

* * * * *